US006622881B2

(12) United States Patent
Hardigg

(10) Patent No.: US 6,622,881 B2
(45) Date of Patent: Sep. 23, 2003

(54) PRESSURE RELIEF VALVE FOR AIR-TIGHT CONTAINERS

(75) Inventor: James S. Hardigg, Conway, MA (US)

(73) Assignee: Hardigg Industries, Inc., South Deerfield, MA (US)

( * ) Notice: Subject to any disclaimer, the term of this patent is extended or adjusted under 35 U.S.C. 154(b) by 0 days.

(21) Appl. No.: 09/881,469

(22) Filed: Jun. 14, 2001

(65) Prior Publication Data

US 2002/0190066 A1 Dec. 19, 2002

(51) Int. Cl.[7] ..... B65D 51/16
(52) U.S. Cl. ..... 220/203.06; 220/745
(58) Field of Search ..... 220/253, 366.1, 220/373, 374, 367.1, 714, 715, 745, 747, 203.05, 203.06

(56) References Cited

U.S. PATENT DOCUMENTS

| | | | | | |
|---|---|---|---|---|---|
| 219,399 | A | * | 9/1879 | Henkel | 108/25 |
| 1,586,781 | A | * | 6/1926 | Case et al. | 116/277 |
| 1,714,368 | A | * | 5/1929 | Hobson | 220/253 |
| 2,189,343 | A | * | 2/1940 | Fritz | 220/253 |
| 2,241,044 | A | * | 5/1941 | Stenberg | 220/253 |
| 3,104,039 | A | * | 9/1963 | Dike | 222/484 |
| 3,454,182 | A | * | 7/1969 | Morton | 137/513.5 |
| 4,165,816 | A | * | 8/1979 | Tupper | 137/493.2 |
| 4,177,831 | A | * | 12/1979 | Benjamin | 137/513.5 |
| 4,190,173 | A | * | 2/1980 | Mason et al. | 220/203.05 |
| 4,251,007 | A | | 2/1981 | Behnisch | |
| 4,500,016 | A | * | 2/1985 | Funfstuck | 222/153.14 |
| 4,516,686 | A | | 5/1985 | Chaussepied | |
| 6,006,939 | A | | 12/1999 | Wai | |
| 6,065,631 | A | | 5/2000 | Oberhofer et al. | |
| 6,161,716 | A | | 12/2000 | Oberhofer et al. | |

FOREIGN PATENT DOCUMENTS

| | | |
|---|---|---|
| BE | 535854 | 3/1955 |
| CH | 319173 | 3/1957 |

* cited by examiner

*Primary Examiner*—Jes F. Pascua
(74) *Attorney, Agent, or Firm*—McCormick, Paulding & Huber LLP

(57) ABSTRACT

A pressure relief valve includes a center hub portion which extends through an aperture formed in a wall of a container. The pressure relief valve further includes a knob having an underside from which the center hub portion extends, a static cavity formed in the underside and a pressure release cavity also formed the underside. A sealing member is fixed to the underside, and encompasses the center hub portion and the static cavity.

19 Claims, 2 Drawing Sheets

PRESSURE RELIEF VALVE FOR AIR-TIGHT CONTAINERS

FIELD OF THE INVENTION

This invention relates in general to a pressure relief valve for airtight containers, and deals more particularly with a pressure relief valve for airtight containers which allows for the selective equalization of interior and exterior container pressures when operated.

BACKGROUND OF THE INVENTION

Pressure relief valves are utilized in many differing applications to maintain a uniform pressure regimen between an interior and an exterior of airtight containers, compartments or other enclosures. The failure of these pressure relief valves, or their absence altogether from a container, may cause significant damage to the structural integrity of containers which experience even a subtle or a momentary change in either the interior or exterior pressures exerted thereon. Of course, damage to the assets within the container may be inflicted by changes in the pressure differential alone, or rather, may be indirectly inflicted owing to the deformation of the container structure during such pressure changes. It is therefore of supreme importance that effective and reliable pressure management be employed by any airtight container which may experience pressure fluctuations.

There are several factors which may contribute to an airtight container experiencing a change in pressure between its interior and its exterior, such as a change in the ambient pressure or a change in the ambient temperature. Changes in the ambient pressure may be attributed to either a barometric change in the vicinity of the container, or to the container itself being moved to a different altitude, typically during airline flights or as a result of the container being submerged under water. When the container is subjected to extended periods of temperatures lower than that which accompanied the closing of the container, a negative pressure regimen may be produced in the container's interior and make opening the container difficult.

Known pressure relief assemblies commonly utilize a manual or automatic valve to compensate for changes in pressure. Two-way automatic valves are designed to open when the pressure differential between the interior and exterior of the container exceeds a predetermined amount, thereby protecting the container vessel from pressure-induced damage which is outside this predetermined range. Such two-way valves are especially useful for very large containers that are transported in un-pressurized aircraft. These valves are termed 'two-way', as they must permit the flow of air out of the container upon ascent of the aircraft while allowing airflow into the container during descent. Many two-way valves include a manually operable button or the like which pushes open the sealing member of the valve to completely equalize the air pressure in the interior and the exterior of the container.

While sufficient for many uses, known two-way valves suffer when subjected to water submersion. A container with an automatic two-way valve having a cracking pressure of approximately 0.5 psi will allow seepage into the container if submerged more than 14 inches under water, a potentially disastrous situation.

Manual pressure relief valves are typically maintained in a closed position, and then opened before the container is transported by aircraft. If the manual valve is left closed during flight, a container may be subjected to several psi of internal pressure which may cause the container's cover to open at least enough for some air to leak out past the container's gasket and thereby provide some measure of pressure equalization. During descent, however, the cover will be pressed tightly upon the gasket and the container will have a great negative internal pressure, possibly causing damage to the container itself or to the assets held therein. Thus, manual pressure relief valves suffer from the potential problem that the valve will not be actuated at the appropriate times prior to and following air transport.

It will therefore be readily apparent that both automatic two-way valves, as well as manual pressure relief valves, cannot protect containers in all situations.

While large cargo containers transported by aircraft typically are provided with automatic two-way valves, manual valves are commonly utilized in small, hand carried containers for a variety of reasons. Some of these containers may be utilized in aquatic sports and thus may be submerged at some time during their lifetime. As a whole, many of the hand carried containers are stored in the passenger areas of an aircraft and so do not experience the pressure differential which is commonly required to trigger the automatic two-way valves. In addition, manual relief valves are oftentimes much more inexpensive than their automatic counterparts and perform admirably provided they are opened and closed at the appropriate times.

FIG. 1 illustrates one such known manual valve assembly 10, including a knob portion 12, a gasket 14 and a threaded screw 16. As depicted in FIG. 1, when the knob portion 12 is screwed down tightly against a wall of a container, the gasket 14 prevents the passage of any air, in either direction, past the threads of the screw 16. When the knob portion 12 is somewhat loosened air is allowed to pass along the threads of the screw 16, the passage rate being increased by an optional axial slot 18 formed in the screw 16.

The manual valve assembly 10 is prone to inoperative damage as the typically metal threads of the screw 16 may strip the joint between the threads and the container wall should the valve assembly 10 be over-tightened, thus inhibiting a tight seal between the gasket 14 and the container wall and allowing for the unintended passage of air. Also of concern with the known manual valve assembly 10 of FIG. 1 is that the valve assembly 10 is not captivated to the container wall and may therefore become completely unscrewed through excessive manual operation, vibration or the like, and subsequently lost.

With the forgoing problems and concerns in mind, it is the general object of the present invention to provide a pressure relief valve which overcomes the above-described concerns and drawbacks, without compromising economic viability and operational effectiveness.

SUMMARY OF THE INVENTION

It is an object of the present invention to provide a pressure relief valve for airtight containers.

It is another object of the present invention to provide a pressure relief valve for airtight containers which is manually operable.

It is another object of the present invention to provide a pressure relief valve for airtight containers which may not be dislodged from its anchoring position.

It is another object of the present invention to provide a pressure relief valve for airtight containers which contains a minimum number of constituent parts and is therefore economic to manufacture.

It is another object of the present invention to provide a pressure relief valve for airtight containers which does not require excessive force to operate.

It is another object of the present invention to provide a pressure relief valve for airtight containers which may be tightly affixed, yet will not damage the container at its anchoring position.

It is another object of the present invention to provide a pressure relief valve for airtight containers which will not strip away from the container at its anchoring position.

According to one embodiment of the present invention a pressure relief valve includes a center hub portion which extends through an aperture formed in a wall of a container. The pressure relief valve further includes a knob having an underside from which the center hub portion extends, a static cavity formed in the underside and a pressure release cavity also formed the underside. A sealing member is fixed to the underside, and encompasses the center hub portion and the static cavity.

These and other objectives of the present invention, and their preferred embodiments, shall become clear by consideration of the specification, claims and drawings taken as a whole.

DETAILED DESCRIPTION OF THE PREFERRED EMBODIMENT

Figure 1:
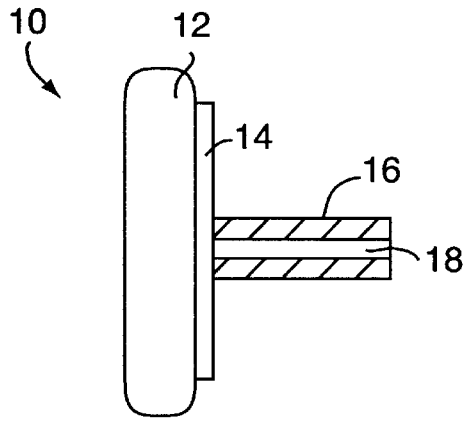
FIG. 1 PRIOR ART
FIG. 1 is a cross-sectional view of a known manual pressure relief valve.
Figure 2:
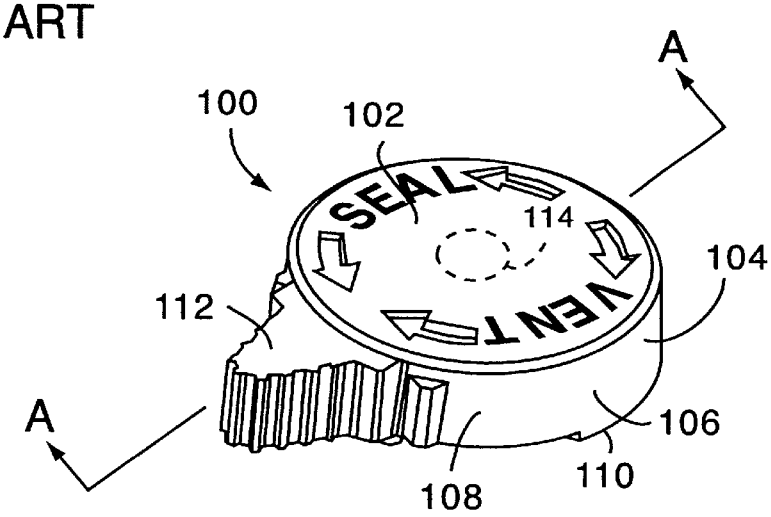
FIG. 2 is a perspective view of a pressure relief valve, according to one embodiment of the present invention.

FIG. 2 illustrates a perspective view of a pressure relief valve 100, according to one embodiment of the present invention. As depicted in FIG. 2, the pressure relief valve 100 includes a circular operation knob 102 with an integrally molded sidewall 104 extending downwardly therefrom. The sidewall 104 is itself formed to include a first continuous sidewall portion 106 and a second continuous sidewall portion 108, the first and second sidewall portions, 106 and 108, defining a lower ridge 110 of the pressure control valve 100. It will also be readily ascertainable from FIG. 2 that the first sidewall portion 106 extends a first distance downwardly away from the knob 102, while the second sidewall portion 108 extends a second distance downwardly away from the knob 102, the first distance being greater than the second distance. In the preferred embodiment of the present invention, the first and second sidewall portions, 106 and 108, each continuously extend approximately halfway around the circumference of the knob 102, forming thereby the continuous lower ridge 110.

While the present embodiment of FIG. 2 has been described as a circular knob 102 having a circumference associated therewith, the present invention is not limited in this regard as the knob 102 may take any geometric shape, without departing from the broader aspects of the present invention.

Returning to FIG. 2, the knob 102 is further equipped with a knurled operation protrusion 112 generally extending radially from the sidewall 104 of the knob 102. The protrusion 112 may alternatively extend from either the first sidewall portion 106 or the second sidewall portion 108, and may be utilized by an operator to assist in the production of torque to selectively rotate the knob 102 in either direction about its center, as will be described in more detail later. Alternatively, the exterior surface of the knob 102 may itself define a knurled, pitted or otherwise engaging or abrasive contoured profile to assist in the manual rotation of the knob 102 during operation.

An integrally molded hub 114, shown with hidden lines in FIG. 2, is centered on the knob 102 and extends in a downwardly direction to engage the wall of an airtight container. As will be appreciated, the knob 102 will rotate about the longitudinal axis of the hub 114 during operation thereof.

Figure 3:
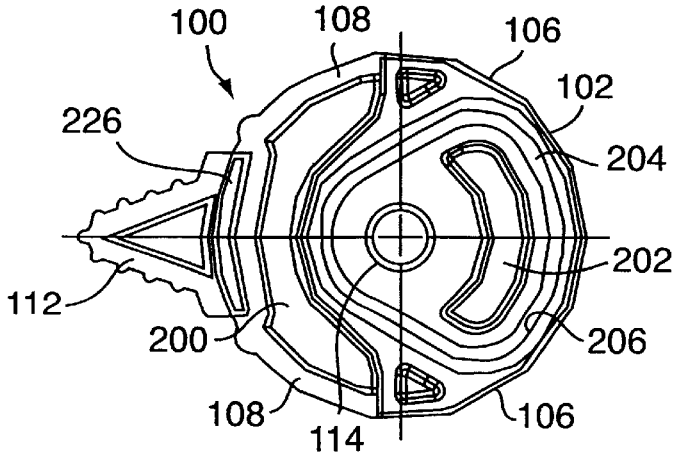
FIG. 3 is a planar view of the underside of the pressure relief valve shown in FIG. 2.

FIG. 3 illustrates a planar view of the underside of the relief valve 100, the underside being in direct opposition to the wall of an airtight container when the relief valve 100 is secured to the wall for operation. As shown in FIG. 3, a pressure release groove 200 and a static pressure groove 202 are integrally formed or molded in the body of the knob 102, and serve to selectively permit or deny, respectively, the passage of air between the interior and the exterior of an airtight container. The dimensional extent of the release groove 200 is approximately coextensive with that portion of the knob 102 which is circumscribed by the second sidewall 108 and provides an avenue for permitting air exchange between the interior and the exterior of an airtight container.

The dimensional extent of the static pressure groove 202 of FIG. 3 is less than that of the release groove 200 and it is oriented to be in alignment with that portion of the knob 102 which is circumscribed by the first sidewall 106. An o-ring 204 is engaged within a sealing groove 206 integrally formed or molded within the body of the knob 102. As shown in FIG. 3, the o-ring 204 has a generally rounded-cornered, triangular shape and encompasses both the hub 114 and the static pressure groove 202.

A downwardly extending lip 226 is also depicted in FIG. 3 and provides structural support for the cantilevered portion of the knob 102, including protrusion 114, when the relief valve 100 is secured to a wall member for operation. It will be readily appreciated that the relief valve 100 may be alternatively formed without the lip 226 without departing from the broader aspects of the present invention.

Figure 4:
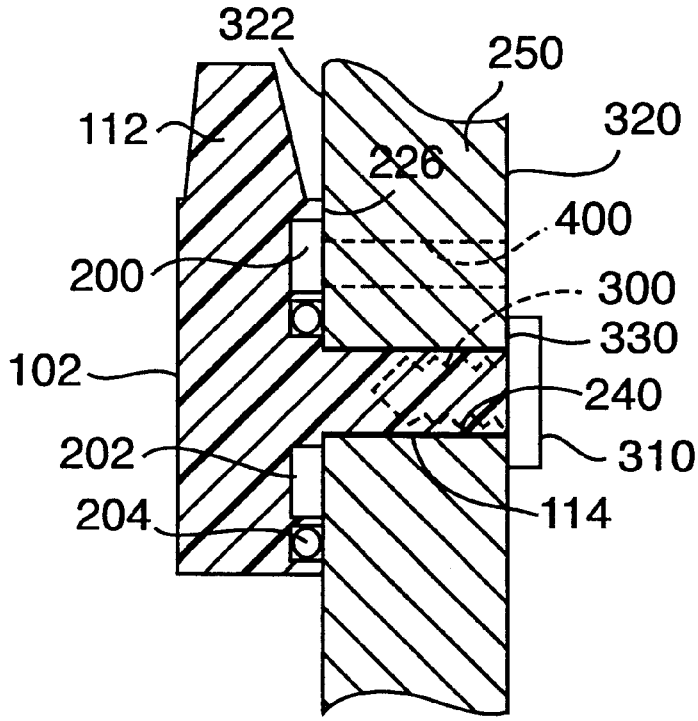
FIG. 4 is a cross-sectional view of the pressure relief valve taken across section line A—A of FIG. 2, as operationally integrated with an exterior wall of an airtight container.

Operation of the relief valve 100 will now be described in conjunction with the cross-sectional view of FIG. 4, taken along section line A—A of FIG. 2. As shown in FIG. 4, the hub 114 of the knob 102 extends through a close fitting aperture 240 in an exterior wall 250 of an airtight container. A thread cutting screw 300 is screwed axially into the hub 114 and secures thereby the knob 102 to the exterior wall 250. In the preferred embodiment of the present invention, the thread cutting screw 300 includes a head portion 310 which has a greater diameter that does the screw 300. In addition, the hub 114 defines an arresting boss 330 against which the head 310 may be secured when fully tightened.

As will be appreciated with reference to FIG. 4, it is an important aspect of the present invention that the hub 114 is not itself fixedly engaged, by a screw joint or the like, with the exterior wall 250 of the container, thereby avoiding the potential for stripping and air leakage associated with the over-tightening of prior art relief valve assemblies, as mentioned previously. Also, the smooth boundary between the hub 114 and the close-fitting aperture 240 in the exterior wall 250 allows for the nimble rotation of the knob 102 during operation, as well as enabling for easy replacement of the knob 102 without damage to the area of the exterior wall 250 immediately adjacent to the close-fitting aperture 240.

It is therefore another important aspect of the present invention that the hub 114 is dimensioned to extend the entire depth of the close-fitting aperture 240 so as to enable the head 310 to be secured against the arresting boss 330. The knob 102 may therefore be tightened against the wall 250 without the inner surface 320 of the exterior wall 250 being subjected to excessive compressive force. In operation, when the screw 300 is tightened, the o-ring 204 may be compressed against the exterior wall 250 a sufficient amount to prevent air seepage, however the head 310 is advantageously prevented from exerting any damaging compressive force on the wall 250, thereby effectively preventing any weakening or cracking of the wall 250 in the area adjacent the close-fitting aperture 240. Moreover, the frictional force applied by the screw 300 to the inner surface 320, as well as the torque required to rotate the knob 102, is prevented from being excessive. While a thread cutting screw 300 has been described, the present invention is not limited in this regard as alternative securing devices may be otherwise employed, such as a screw and washer assembly having a screw-head dimension coextensive with that of the hub 114, or the like, without departing from the broader aspects of the present invention.

Returning to FIG. 4, as the screw 300 is tightened against the arresting boss 330, the o-ring 204 will be compressed against the exterior wall 250 with a force sufficient to prevent air seepage from the area encompassed by the o-ring 204, including from the close-fitting aperture 240. By isolating the area encompassed by the o-ring 204, the static pressure groove 202 is likewise isolated from gaseous communication with the outside atmosphere even during those times when the knob 102 is rotated to position the static pressure groove 202 above an air pressure conduit 400 formed through the exterior wall 250.

As depicted in FIG. 4, the air pressure conduit 400 is a simple, elongated and continuous conduit which extends from the inner surface 320 of the exterior wall 250 to the exterior surface 322 thereof. The conduit 400 preferably has a circular cross-section of approximately one-eight (⅛) the diameter of the knob 102 and may extend through the exterior wall 250 at any angle provided that its opening on the exterior surface 322 is oriented so as to selectively come into gaseous communication with both the pressure release groove 200 and the static pressure groove 202 upon rotational operation of the knob 102. While the air pressure conduit 400 has been described as having a circular cross-section, a conduit having any geometric cross-section is also contemplated by the present invention. The optional lip 226 is also depicted, in phantom line, in FIG. 4.

As will be appreciated by consideration of FIGS. 2–4 in combination, as well as the disclosure pertaining thereto, the knob 102 may be selectively rotated to enable the conduit 400 to come into gaseous communication with the static pressure groove 202 and thus that area of the knob 102 which is encompassed and sealed by the o-ring 204. With the knob 102 in such an orientation, airflow between the interior and the exterior of the container is effective prohibited. When the knob 102 is rotated approximately 180° however, the conduit 400 will come into gaseous communication with the pressure release groove 200 and thus that portion of the knob 102 defined by the shortened sidewall 108 which is vented to the ambient atmosphere. While in this location, the conduit 400 permits effective pressure equalization between the container interior and the ambient atmospheric pressure.

As depicted in the embodiment of FIGS. 2–4, the pressure relief valve 100 includes a static pressure groove 202 as well as a continuous sidewall 104 having portions of non-uniform depth, however alternative embodiments are also contemplated by the present invention. It will be readily appreciated that the knob 102 may be formed without the static pressure groove 202 while still providing for the effective operation of the valve 100, provided that the portion of the underside of the knob 102 which is positioned opposite the conduit 400 is encompassed by the o-ring 204.

Figure 5:
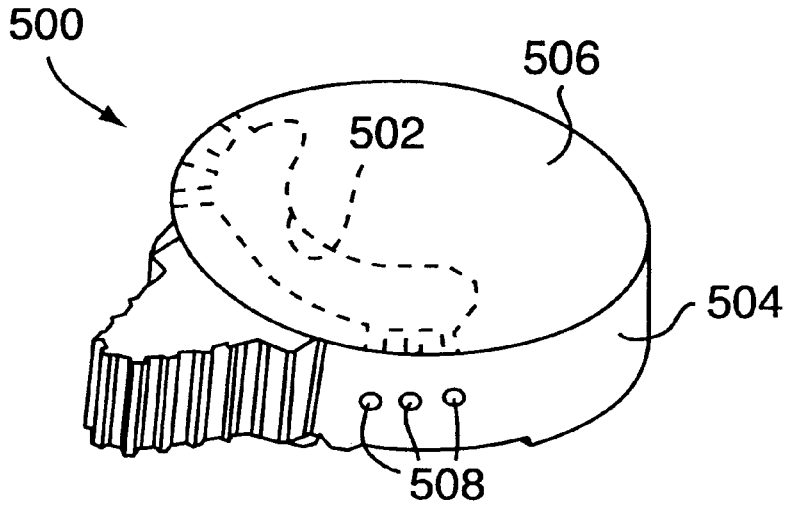
FIG. 5 is a perspective view of a pressure relief valve, according to another embodiment of the present invention.

Similarly, a pressure relief valve 500 according to another embodiment of the present invention may be alternatively formed having a continuous sidewall 504 of uniform depth, as depicted in FIG. 5. As illustrated in FIG. 5, a pressure release groove 502 is formed in the underside of the knob 506 for selective position in opposition to an unillustrated air pressure conduit in a wall member. In contrast to the relief valve 100 depicted in FIGS. 2–4, the pressure release groove 502 provides pressure equalization through one or more equalization conduits 508 which extend from the uniform-depth sidewall 504 to the pressure release groove 502. It will be readily appreciated that the conduits 508 may be formed anywhere on the knob 506, provided that they enable gaseous communication between the pressure release groove 502 and ambient atmosphere, without departing from the broader aspects of the present invention.

It will also be readily appreciated that the pressure relief valves of the present invention may be formed as a single, integrally molded device, or alternatively, be comprised of a plurality of separately molded or formed elements capable of functional integration with one another, without departing from the broader aspects of the present invention. Moreover, the pressure relief valves of the present invention are preferably formed from a plastic or polymer material, however alternative resilient, metallic and non-metallic materials are also contemplated by the present invention.

While the invention had been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A pressure relief valve including a center hub portion which extends through an aperture formed in a wall of a container, said pressure relief valve comprising:

a knob having an underside from which said center hub portion extends;

a static cavity formed in said underside;

a pressure release cavity formed in said underside; and a sealing member fixed to said underside, said sealing member encompassing said center hub portion and said static cavity while excluding said pressure release cavity.

2. The pressure relief valve including a center hub portion which extends through an aperture formed in a wall of a container according to claim 1, wherein:

said sealing member comprises an O-ring which is captured in a sealing groove formed in the underside of said knob; and said sealing groove has a generally triangular shape with rounded corners.

3. The pressure relief valve including a center hub portion which extends through an aperture formed in a wall of a container according to claim 1, wherein:

said center hub extends through said aperture a predetermined distance to be substantially coplanar with an inner surface of said wall, thereby forming an arresting boss.

4. The pressure relief valve including a center hub portion which extends through an aperture formed in a wall of a container according to claim 3, further comprising:

a fastening means which extends into and mates with said central hub portion, thereby compressing said sealing member between said underside of said knob and said wall; and said fastening means includes a head which abuts said arresting boss.

5. The pressure relief valve including a center hub portion which extends through an aperture formed in a wall of a container according to claim 4, wherein:

said fastening means comprises one of a screw and a bolt.

6. The pressure relief valve including a center hub portion which extends through an aperture formed in a wall of a container according to claim 1, further comprising:

a first continuous sidewall portion and a second continuous sidewall portion, said first and second sidewall portions substantially defining an outer periphery of said knob; and wherein said first and second sidewall portions are of unequal heights.

7. The pressure relief valve including a center hub portion which extends through an aperture formed in a wall of a container according to claim 6, wherein:

said first sidewall portion has a greater height than said second sidewall portion;

said static cavity comprises an arcuate groove formed in said underside of said knob in alignment with said first sidewall portion; and said pressure release cavity comprises an arcuate groove formed in said underside of said knob in alignment with said second sidewall portion.

8. The pressure relief valve including a center hub portion which extends through an aperture formed in a wall of a container according to claim 1, further comprising:

a knurled operation protrusion which extends radially from said knob.

9. A pressure relief valve selectively equalizing a pressure between an interior of a container and ambient atmosphere, said container including a pressure conduit extending through a wall of said container to provide communication between said interior and said ambient atmosphere, said pressure relief valve comprising:

a knob having a static area not in communication with said ambient atmosphere and a pressure release area in communication with said ambient atmosphere; and wherein operation of said knob selectively positions said pressure conduit in exclusive communication with said static area and said pressure release area.

10. The pressure relief valve selectively equalizing a pressure between an interior of a container and ambient atmosphere, according to claim 9, further comprising:

a center hub extending from said knob for securing said knob to said wall; and a sealing member supported on an underside of said knob, said sealing member encompassing said center hub and said static area.

11. The pressure relief valve selectively equalizing a pressure between an interior of a container and ambient atmosphere, according to claim 10, wherein:

said center hub extends through said wall to be substantially coplanar with an inner surface of said wall, thereby forming an arresting boss.

12. The pressure relief valve selectively equalizing a pressure between an interior of a container and ambient atmosphere, according to claim 11, further comprising:

a fastening means which extends into and mates with said central hub portion, thereby compressing said sealing member between said underside of said knob and said wall; and said fastening means includes a head which abuts said arresting boss.

13. The pressure relief valve selectively equalizing a pressure between an interior of a container and ambient atmosphere, according to claim 12, further comprising:

said fastening means comprises one of a screw and a bolt.

14. The pressure relief valve selectively equalizing a pressure between an interior of a container and ambient atmosphere, according to claim 9, further comprising:

a first continuous sidewall portion and a second continuous sidewall portion, said first and second sidewall portions substantially defining an outer periphery of said knob; and wherein said first and second sidewall portions are of unequal heights.

15. The pressure relief valve selectively equalizing a pressure between an interior of a container and ambient atmosphere, according to claim 14, further comprising:

said first sidewall portion has a greater height than said second sidewall portion;

said static cavity comprises an arcuate groove formed in said underside of said knob in alignment with said first sidewall portion; and said pressure release cavity comprises an arcuate groove formed in said underside of said knob in alignment with said second sidewall portion.

16. The pressure relief valve for selectively equalizing a pressure between an interior of a container and ambient atmosphere, according to claim 10, further comprising:

said sealing member comprises an o-ring which is captured in a sealing groove formed in the underside of said knob; and said sealing groove has a generally triangular shape with rounded corners.

17. The pressure relief valve for selectively equalizing a pressure between an interior of a container and ambient atmosphere, according to claim 9, further comprising:

said knob includes an equalization conduit in gaseous communication with said pressure release area and said ambient atmosphere.

18. A method of selectively equalizing a pressure between an interior of a container and ambient atmosphere utilizing a pressure relief assembly, said method comprising the steps of:

forming a pressure conduit through a wall of said container;

rotatably securing an operation knob of said pressure relief assembly to said wall such that said pressure conduit may be selectively oriented to be in exclusive communication with a static area of said knob and a pressure release area of said knob;

rotating said knob to a first position where said pressure conduit is in communication with said static area to isolate said interior from said ambient atmosphere; and rotating said knob to a second position where said pressure conduit is in communication with said pressure release area to permit pressure equalization between said interior and said ambient atmosphere.

19. The method of selectively equalizing a pressure between an interior of a container and ambient atmosphere utilizing a pressure relief assembly, according to claim 18, said method of rotatably securing said operation knob comprising the steps of:

extending a center hub of said knob through an aperture in said wall a predetermined distance to be substantially coplanar with an inner surface of said wall, thereby defining an arresting boss;

extending a fastening means into said center hub; and tightening said fastening means until a head portion of said fastening means abuts said arresting boss.

* * * * *